US005306106A

United States Patent [19]

Mileti

[11] Patent Number: 5,306,106

[45] Date of Patent: Apr. 26, 1994

[54] IMPACT ATTENUATOR

[76] Inventor: Robert Mileti, 16 Balmoral St., Unit 401, Andover, Mass. 01810

[21] Appl. No.: 929,409

[22] Filed: Aug. 14, 1992

[51] Int. Cl.[5] ..... E01F 13/00

[52] U.S. Cl. ..... 404/6; 404/10

[58] Field of Search ..... 404/6, 9, 10, 25

[56] References Cited

U.S. PATENT DOCUMENTS

| | | | |
|---|---|---|---|
| Re. 29,544 | 2/1978 | Fitch . | |
| 3,591,144 | 7/1971 | Iving | 404/10 X |
| 4,073,482 | 2/1978 | Seegmiller et al. | 404/6 X |
| 4,289,419 | 9/1981 | Young et al. . | |
| 4,475,101 | 10/1984 | Kulp et al. | 414/6 X |
| 4,557,466 | 12/1985 | Zucker . | |
| 4,710,053 | 12/1987 | Kulp et al. | 404/6 X |
| 4,934,661 | 6/1990 | Denman et al. . | |
| 4,973,189 | 11/1990 | Bechtold | 404/6 |
| 5,002,423 | 3/1991 | Mileti | 404/6 |
| 5,026,204 | 6/1991 | Kulp et al. | 404/10 |

FOREIGN PATENT DOCUMENTS

| | | | |
|---|---|---|---|
| 1378954 | 1/1975 | United Kingdom | 404/10 |

*Primary Examiner*—Mark Rosenbaum
*Assistant Examiner*—Frances Chin
*Attorney, Agent, or Firm*—Nies, Kurz, Bergert & Tamburro

[57] ABSTRACT

An impact attenuator module having an interior domed shell positioned at a selected one of several heights within an annular shell for supporting a selected quantity of dispersable mass at a desired height above the bottom of the module.

8 Claims, 1 Drawing Sheet

IMPACT ATTENUATOR

The present invention relates to impact attenuators placed adjacent a hazardous fixed object in the highway environment to control the rate of deceleration of a vehicle as it approaches the object.

U.S. Pat. No. Re. 29,544, the disclosure of which is incorporated herein by reference, discloses an impact attenuator of this type which has gone into wide spread use. It comprises one or more frangible containers or barrier modules each containing a dispersible mass such as sand, the center of gravity of which is elevated to a level which approximates the level of the center of gravity of the average vehicle. To position the center of gravity of the dispersible mass at the desired level the mass is supported on a lightweight core assembly placed at the bottom of the module. The modules in the barrier array are provided with different mass configurations typically to effect total weights of 400 lbs., 700 lbs., 1400 lbs. or 2100 lbs. Since the center of gravity of at least the three lighter modules must be disposed at the same height, different cores of different dimensions are required. While these prior impact attenuators perform their function well, the core structures, usually molded from low density expanded polystyrene, often make the post impact clean up difficult. Also the relatively large core structures are cumbersome and expensive to ship and store.

With the foregoing considerations in mind it is a principal purpose and object of the present invention to provide improved impact attenuator modules of the general type disclosed in U.S. Pat. No. Re. 29,544 which overcome the disadvantages and expense associated with the core structures utilized in such prior modules without detracting from the performance of the system, the effectiveness of which has been demonstrated throughout the many years they have been installed on the highways.

It is a further object of the present invention to provide a single universal configuration of components for impact attenuator modules so that different weight modules may be assembled from the same group of basic components.

It is a further object of the present invention to provide improved impact attenuator modules which are so constructed as to reduce the volume of scrap which must be disposed of after impact.

It is also an object of the present invention to simplify and shorten the assembly process for the impact attenuator modules thereby reducing risk to maintenance men who frequently accomplish this task in hazardous locations on the highway.

It is another object of the present invention to provide improved impact attenuator modules which, even when filled, may be moved easily from location to location on the roadway as required by progress on construction sites where impact attenuators have met with increasing use.

In attaining these and other objects the present invention provides improved improved impact attenuator modules comprising, in a preferred form, a pair of identical semi-cylindrical halves and a single domed shell structure which rests on integral flanges molded into the module halves at specific locations to produce one of several module weights all with the same proper elevated center of gravity.

Additional objects and advantages of the present invention will become apparent as the description proceeds in connection with the accompanying drawings in which.

Figure 1:
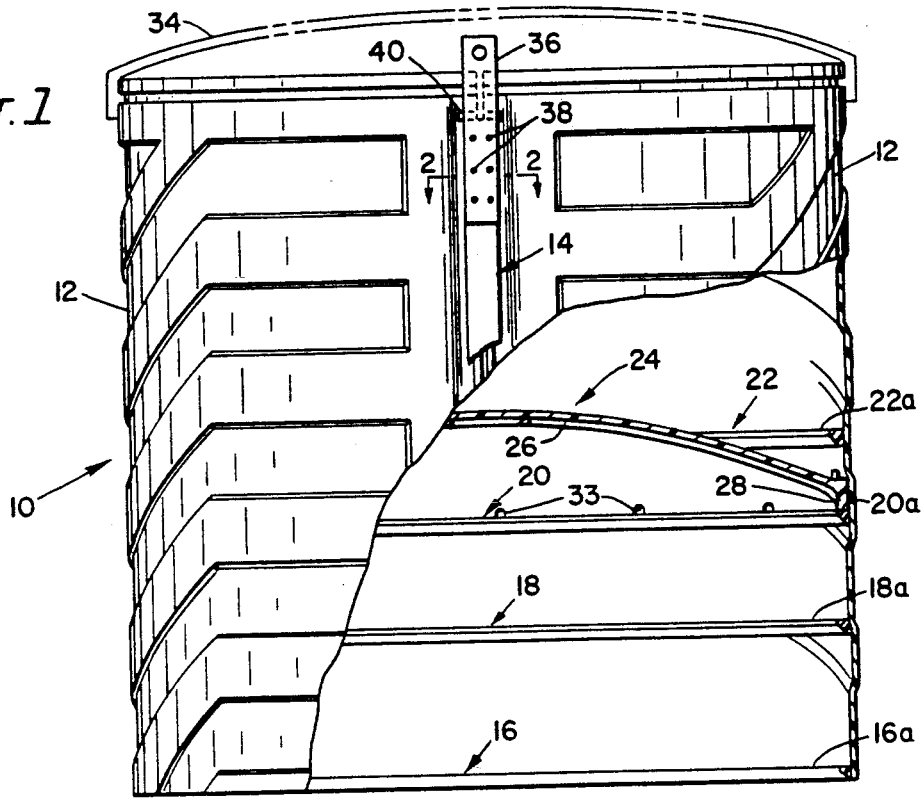
FIG. 1 is an elevation of a impact attenuator module embodying the present invention with parts broken away to show interior details.
Figure 2:
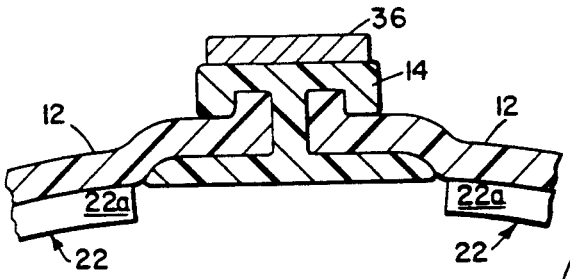
FIG. 2 is an enlarged section taken along line 2—2 of FIG. 1 showing details of the connection between the two module halves.
Figure 3:
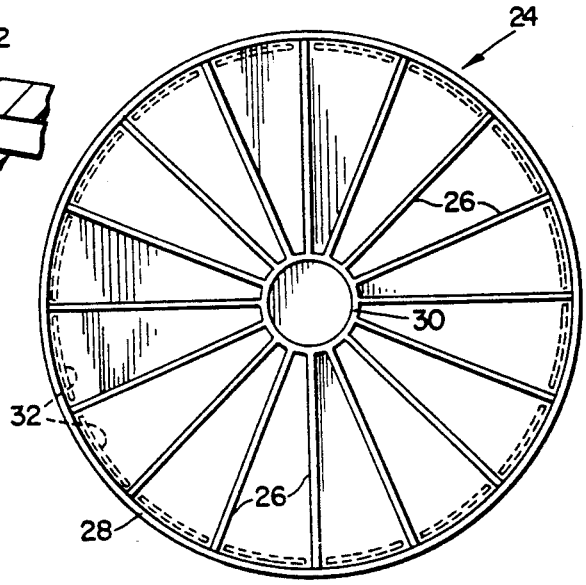
FIG. 3 is a reduced bottom plan view of one component of the module.

Referring now more particularly to the drawings, the barrier module shown therein is, as noted above, of the general type disclosed in U.S. Pat. No. Re 29,544. While only a single module is shown herein it is to be understood that modules may be disposed in a variety of arrays, for example, as shown in the '544 patent.

Each module 10 comprises a pair of identical semi-cylindrical halves 12 which may be joined together along their edges as shown in the '544 patent. Preferably, however, the module halves are joined by connector strips 14, the construction and installation of which are disclosed in U.S. Pat. No. 5,002,423.

In the module halves of the '544 patent the inner surfaces are smooth to accommodate the polystyrene cores of varying heights without obstruction. In the present invention, on the contrary, four vertically spaced annular flanges 16, 18, 20 and 22 are molded integrally to extend completely around the inner surface of the module except for a short discontinuity at the marginal edges of each of the modules to accommodate the connector strips 14. Typically the flanges project inwardly from the module halves ⅜" and have flat upper surfaces 16*a*, 18*a*, 20*a* and 22*a*, which provide solid strong support surfaces extending essentially around the entire periphery of the module for supporting a domed shell 24 which forms a principal component of the present invention.

The shell is preferably formed as a portion of a sphere in a typical case having a radius of 40 inches. The maximum diameter of the shell which corresponds essentially to the interior diameter of the module is 35½ inches. The shell is preferably molded of polypropylene, which, like the module halves formed of the same material, provide sufficient strength and stability and yet sufficient frangibility to break into small pieces when struck by an impacting vehicle. To afford the necessary strength the shell is provided on its under side with a series of strengthening ribs 26 which extend from an outer essentially cylindrical skirt 28 to a central circular rib 30. Additional segmental ribs 32 are formed integrally with the upper surface of the dome to facilitate stacking the shells for storage and shipment. A series of weep holes 33 are provided in the lower edge of the shell to permit any moisture in the sand mass to drain. In this configuration the shell, despite its lightweight, can support the 2100 lbs of sand within the module when the module is fully filled and the support shell is installed on the bottom most flange 16.

The upper flanges 18, 20, and 22 are located so as to support the shell at the proper height in the three primary weight configurations. More specifically when the shell is installed on the flange 18 the space above the shell will be loaded with some 1400 lbs of sand to dispose the center of gravity of the entire module at a height of some 24 inches above ground level. When the shell 24 is disposed on the flange 20 as shown in FIG. 1 the upper portion will be loaded with 700 lbs of sand which will dispose the center of gravity of the loaded module at essentially the same height. Similarly, when the shell is disposed on the upper most flange 22 the upper portion of the module will be loaded with 400 lbs of sand, the height of the center of gravity of the entire module remaining the same, i.e. at approximately 24 inches above ground level. To maintain the center of gravity of the module at the desired height in the three different weight configurations the flange 18 is typically located 8⅜ inches above the bottom of the module, the flange 20 is located at 14 ⅜ inches above the bottom of the module and the flange 22 is located 19 inches above the bottom of the module. These dimensions have been selected since the experience encountered in the use of thousands of modules of the type shown in the '544 patent disposed in arrays of modules having these various weights has provided of a wealth of data which affords a guide for the installation of the barrier array in any particular location thus eliminating the need for re-engineering each array. It will be understood, however, that should conditions change the support flanges can be provided in any number and at any height required.

The method of assembly and use of the modules is the same for all weight configurations. The modules are shipped to a site knocked down and are erected, assembled and filled on the site. In the assembly of the modules the two semi-cylindrical halves are placed on the road surface upside down with their vertical flanges closely adjacent. Then one set of connector strips 14 is slid own along the flanges locking together the two cylinder halves on one side only in accordance with the procedure described in U.S. Pat. No. 5,002,423. Next, the support shell 24 is placed, convex side down, just below the flange on which it is desired to rest when the module is right side up. The second set of connector 14 strips is then slid down the flanges on the opposite side of the module locking the two module halves together with a shell trapped in place. When the assembled module is then turned right side up the shell will fall to rest on the selected flange ready to be filled with sand. The module is then moved to its final position and filled with the desired weight of sand. The installation is completed by snapping a lid 34 in place.

Normally the modules remain in place indefinitely and are replaced or moved only when impacted by a vehicle. However modules of this type have been used with increasing frequency to protect temporary construction sites. This requires that the filled modules be moved from place to place, a requirement which could not be met or met with considerable difficulty with the construction shown in the '544 patent. With the construction shown in the present invention the attachment of a lifting lug 36 to each top connector strip, for example by screws 38, permits the fully assembled and filled module to be lifted using a conventional sling, not shown, and moved from place to place as required. The weight of the module is transferred through the connector strips 14 and the molded stops 40 described in the '423 patent so that the sand mass is entirely supported by the dome and the associated flange free of any ground support.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An impact attenuator module comprising a substantially cylindrical frangible housing, said housing having two substantially identical semi-cylindrical halves, connector strips securing adjacent edges of said housing halves together, said housing having a lower edge for resting on a supporting surface and an upper edge for receiving a lid, a plurality of flanges projecting from the interior of said housing, each of said flanges extending essentially entirely around the interior of said housing, one of said flanges being closely adjacent the lower edge of said housing and the remaining flanges being spaced at selected intervals above said lower edge, and a frangible shell supported on a selected one of said flanges for supporting a dispersible mass on its upper surface.

2. The impact attenuator module according to claim 1, together with lifting lugs secured to said connector strips for attachment to a lifting device to permit movement of said module from place to place when fully assembled.

3. The impact attenuator module according to claim 1, wherein said shell is of arcuate section and is disposed on said flange in upwardly convex configuration.

4. The impact attenuator module according to claim 3 wherein said shell is formed as a shallow spherical segment.

5. The impact attenuator module according to claim 1, wherein the space within said housing above said shell contains a selected quantity of sand and the portion of said housing below said shell is empty.

6. The impact attenuator module according to claim 1, wherein said remaining flanges are three in number and wherein said dispersible mass is sand, said flanges being so disposed within said housing that when said shell is positioned on said uppermost flange and the space above the shell contains 400 pounds of sand and when the shell is positioned on the intermediate flange the space above said shell, contains 700 pounds of sand and when the shell is positioned on the lowest of said remaining flanges the space above said shell contains 1400 pounds of sand, the center of gravity of said module is substantially at the same height above said lower edge.

7. The impact attenuator module according to claim 6, wherein the height of the center of gravity of the module is approximately 24 inches above said lower edge of said module.

8. The impact attenuator module according to claim 1, together with a lid carried by said upper edge of said housing.

* * * * *